US005701748A

United States Patent [19]

Phelps et al.

[11] Patent Number: 5,701,748

[45] Date of Patent: Dec. 30, 1997

[54] EVAPORATIVE COOLER FOR AIR CONDITIONING CONDENSING UNIT

[76] Inventors: Jack LeRoy Phelps; Bernard Maurice Paquette, both of P.O. Box 189, Cathedral City, Calif. 92235

[21] Appl. No.: 659,575

[22] Filed: Jun. 6, 1996

Related U.S. Application Data

[60] Provisional application No. 60/000,135, Jun. 12, 1995.

[51] Int. Cl.[6] ..... F25D 17/06

[52] U.S. Cl. ..... 62/91; 62/121; 62/171; 62/305; 62/506

[58] Field of Search ..... 62/506, 507, 305, 62/310, 171, 183, 121, 89, 91

[56] References Cited

U.S. PATENT DOCUMENTS 4,170,117 10/1979 Faxon ..... 62/305
5,605,052 2/1997 Middelton et al. ..... 62/305

*Primary Examiner*—John M. Sollecito
*Attorney, Agent, or Firm*—Dennison, Meserole, Pollack & Scheiner

[57] ABSTRACT

An evaporative cooling system externally mounted around an air cooled condenser to increase the rate of heat transfer. Spray cooling takes place in stages around succeeding portions of the condenser as determined by thermostats which respond to increasing condenser air discharge temperature.

10 Claims, 3 Drawing Sheets

EVAPORATIVE COOLER FOR AIR CONDITIONING CONDENSING UNIT

This application claims the benefit of U.S. Provisional Application No. 60/000,135, filed Jun. 12, 1995, a copy of which is attached.

BACKGROUND OF THE INVENTION

This invention relates to an externally mounted attachment to spray water on the condenser of an air conditioning unit to increase the rate of heat transfer. Residential air conditioning condensing units are designed and rated to operate at 95° F. dry bulb. When the ambient temperature approaches and rises above this level, cooling capacity drops, power consumption increases, and the compressor is forced to operate in its uppermost stressful design range.

It is well known to employ evaporative cooling to lower the temperature of the air passing through the condenser. In this manner, the condensing unit can be made to operate more efficiently with only a modest increase in the cost of water.

The techniques of spraying water on an air cooled condenser are as old as air conditioning itself. As applied to residential air conditioning, numerous patents have been issued disclosing systems to achieve this result. U.S. Pat. No. 4,028,906 shows a nozzle 30 medially mounted above the condenser to supply a fan-shaped curtain of finely atomized water across the face of the condenser. U.S. Pat. No. 4,240,265 shows a nozzle 18 supported by wire hooks looped over the condenser tubing. A temperature sensor 60 turns the spray on an off. U.S. Pat. No. 4,672,817 shows a perforated tube 46 surrounded by wicking material 48 mounted on the upper periphery of a condenser. Water supplied to the tube wets the wicking material which allows for a controlled wetting of the condenser. U.S. Pat. No. 5,285,651 shows a manifold conduit 25 on the upper part of the condenser for supplying water to a series of spray nozzles 27.

Despite the existence of a large body of art directed to this technology and its acknowledged benefits, commercial usage has been minimal. There are three main reasons causing this unfavorable acceptance: (1) blocking of the condenser by minerals left behind by the evaporating water; (2) system imbalance caused by poor control of evaporative cooling under conditions of low wet bulb and dry bulb ambient air; and (3) excessive water usage and wetting of the area surrounding the condensing unit. These problems have been addressed in a novel manner by the disclosed invention.

SUMMARY OF THE INVENTION

The overall object of the present invention is to provide an externally mounted water spraying system automatically controlled by thermostats and solenoid valves to spray water on the condenser. Spraying is applied in stages with each stage acting on a separate portion of the condenser under control of its own thermostat. In this manner, more precise control of the condensing unit operating pressures are obtained along with better control of water usage.

It is another object of the invention to manage condenser fouling by selecting a lead stage where fouling is most likely to occur and placing a velocity sensor behind it to signal condenser fouling.

It is another object of the invention to control the spray angle and spacings of the nozzles to reduce condenser fouling.

It is yet another object of the invention to arrange a plurality of sealed snap-acting bimetal discs around the condenser internally of the condensing unit to operate the fluid control solenoid valves.

DESCRIPTION OF PREFERRED EMBODIMENTS

Figure 1:
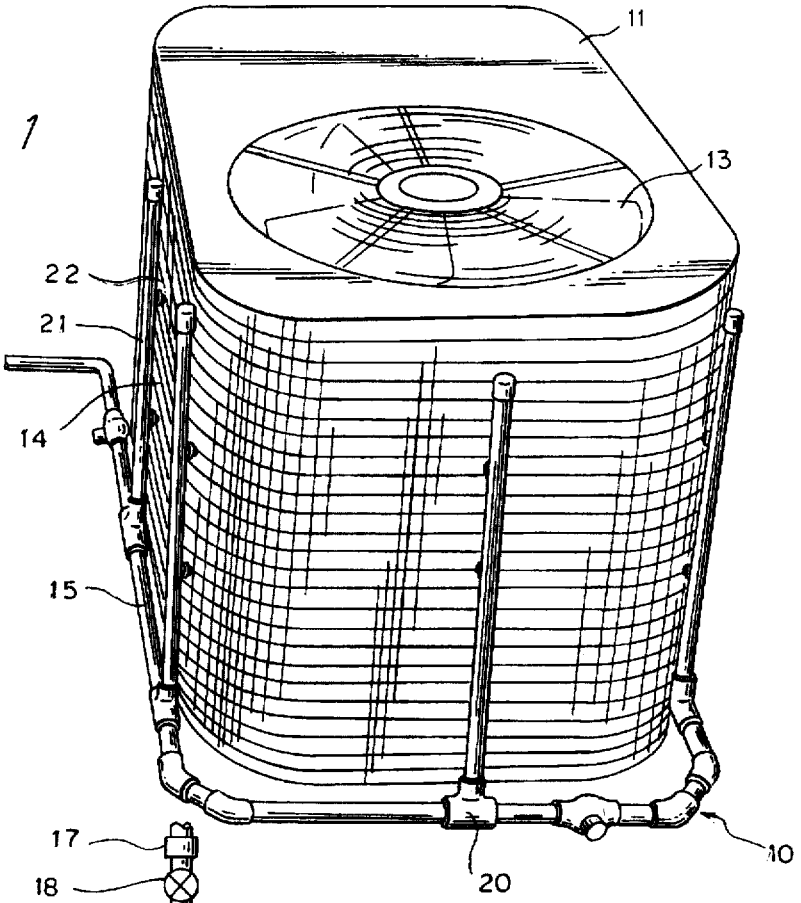
FIG. 1 is a perspective view showing the spray system installed on a condensing unit.
Figure 2:
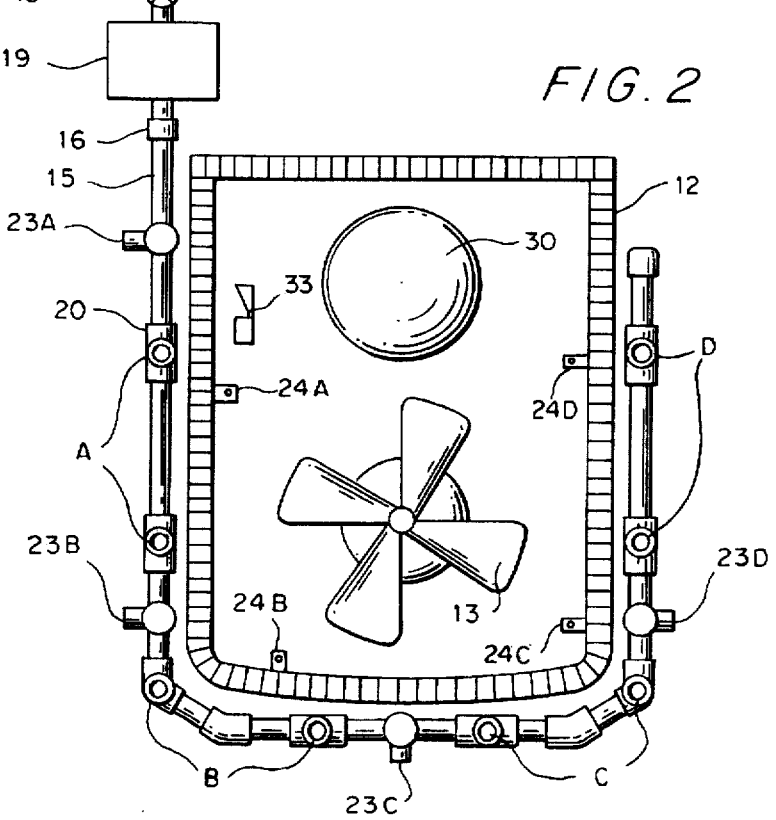
FIG. 2 is a partly schematic top plan view of FIG. 1.
Figures 3, 4:
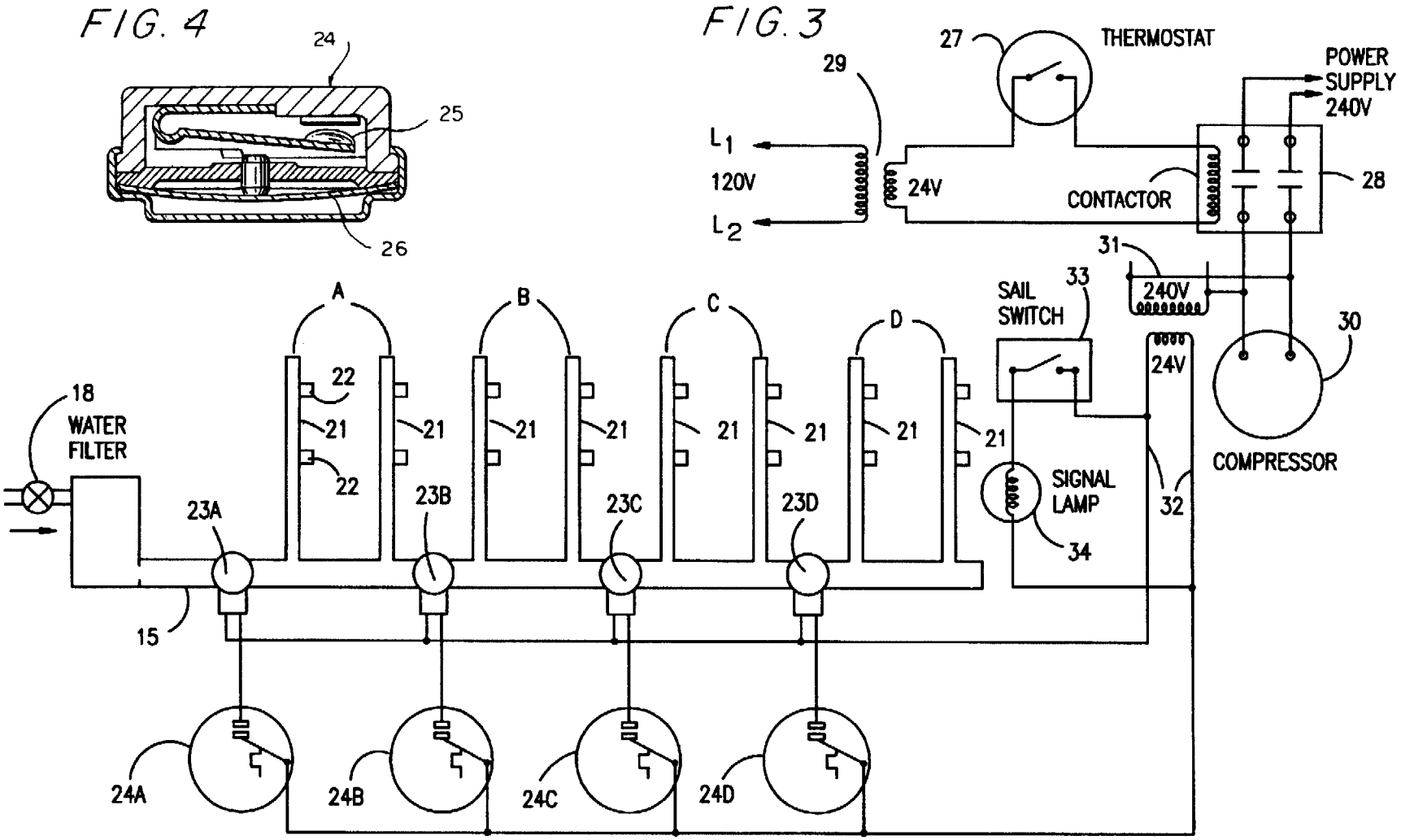
FIG. 3 is a schematic drawing of the piping and electrical circuit of the preferred embodiment.
FIG. 4 is a schematic drawing of an embodiment showing a parallel flow arrangement.

Referring now in general to the drawings and in particular to FIGS. 1–3, the novel spray system 10 of the invention is shown installed around a condensing unit 11. The condensing unit is of the style having a U-shaped wrap-around condenser 12 with a top mounted condenser fan 13 to draw air through the condenser and discharge it vertically. A grille 14 surrounds the condenser to protect the fins from damage.

While the invention is described with respect to a condensing unit with a U-shaped wraparound condenser, it should be clearly understood that the invention can be applied to condensing units having circular, rectangular and square shapes.

A U-shaped manifold 15 is installed around the base of the condensing unit and is secured thereto by fasteners, not shown. The manifold may be formed of copper tubing and sweat fittings or of plastic tubing such as PVC used in the plumbing trades. Because of its low cost, durability, and ease of assembly with a quick drying adhesive and a wide range of fittings, PVC tubing having a ⅞" OD and ¾" ID is preferred. The manifold has an inlet 16 supplied with water from any convenient service such as a high pressure garden hose 17. A manual shutoff valve 18 is added for maintenance purposes. As an optional feature, a mineral filter 19 may be installed at the inlet when conditions warrant its use.

A number of tee fittings 20 are provided in the manifold 15 at substantially equally spaced intervals to roughly demarcate the condenser into approximately equal sections. A vertical tube 21 is secured in the stem of each tee to overlie the condenser from bottom to top. The open branch of the tee at the manifold end is capped off. Each vertical tube carries spaced nozzles 22 which direct a spray toward the condenser. The vertical tubes, here shown as eight in number, are divided into four spray stages numbered A, B, C and D in FIGS. 3 and 4. Stage A closest to the inlet is designated as the lead stage.

Manifold 15 is supplied with a number of electrically operated solenoid valves 23 in series flow relationship. A solenoid valve is installed at the inlet of each stage and is accordingly designated 23A, 23B, 23C and 23D on the drawings. When solenoid valve 23A is energized, stage A is activated to spray water on its specific section of the condenser while stages B, C and D remain inactive. When stage B is activated along with stage A, the condenser sections opposite stages A and B are sprayed with water and so forth down the line with stages C and D.

The solenoid valves 23 are under control of designated thermostats 24 which are accordingly numbered 24A, 24B, 24C and 24D on the drawings. The thermostats 24, schematically shown in FIG. 3, are of the bimetal disc type. These thermostats are commercially available from Kidde-Fenwal Inc. of Ashland, Mass., and are briefly described in FIG. 4 which shows a thermostat with normally open contacts 25 movable to a closed position by bimetal disc 26. The switch is sealed in a protective housing. These thermostats are provided with fixed closing and opening temperature settings. In the particular application shown on the drawings, the thermostat settings were selected as follows:

24A —close at 90° and open at 80° F.

24B —close at 100° and open at 90° F.

24C —close at 110° and open at 100° F.

24D —close at 120° and open at 110° F.

Thermostats 24A–24B are mounted internally of the condensing unit opposite their respective stages. The thermostats are mounted about ⅓ of the way down the condenser to respond to an average air temperature reading. They are supported in spaced relation on the condenser to sense air temperature rather than condenser fin surface temperature. Any suitable hook around the condenser tubing or a clip secured to the condenser fins may be employed to support the thermostats.

Referring now to FIG. 3, the electrical circuit of the invention will be described. In conventional fashion, a room thermostat 27, when calling for cooling, energizes the operating coil of contactor 28 from a 24V transformer 29. Power is then supplied to compressor 30 along with fan 13 (FIG. 2). A 24V power transformer 31 having a 24V secondary and 240V primary is connected to the load side of contactor 28 to be energized along with compressor 30. Solenoid valves 23A–23D, along with their associated thermostats 24A–24D, are wired in parallel across legs 32 of 24V power transformer 31. Closure of the contacts in thermostats 24A–24D energizes the associated solenoid valve 23A–23D.

As an optional feature, a circuit may be added to signal that the condenser needs cleaning. A conventional sail switch 33 and signal lamp 34 are wired across the 24V secondary of power transformer 31. Sail switch 33 is a conventional component placed within air ducts to sense air velocity. It includes a thin switch operating membrane placed in the airstream. When the air velocity drops to a predetermined level, the switch contacts are closed energizing signal lamp 34. Sail switch 33 is preferably placed internally of the condensing unit opposed to stage A which is most likely to be the first stage to be obstructed with mineral deposits.

A step-by-step operational description of the preferred embodiment will now be given. Assume a hot summer day when the temperature in the morning is about 85° F. and gradually rises until it peaks out at 98° F. in the late afternoon and then begins to decline back to 85° F. and below at night. Starting in the morning with the thermostat set at 75° F., contactor 28 will be energized supplying power to compressor 30. At the same time, transformer 31 and lines 32 will supply power to thermostats 24A–24D and solenoids 23A–23D. Since ambient air is already 85° F. and the heat rejected by the condenser will be at least 10 degrees above that, thermostat 24A will close energizing solenoid 23A. Water will then flow through manual valve 18, filter 19, into manifold pipe 15, through opened valve 23A into vertical pipes 21 of stage A and through nozzles 22 onto the condenser portion opposite stage A. As the ambient temperature continues to rise to the peak level of 98° F. in the late afternoon, stages B, C and D will be successively added. After the peak temperature hours have passed, the reverse will take place with stages D, C and B shutting down, leaving only stage A. If the temperature continues to fall during the night, stage A will shut down returning operation to normal unconditioned ambient air.

From the above, it can be seen that lead stage A will be in operation more than the other stages, and if any condenser fouling occurs, it will occur at this location first. That is why the sail switch 33 is placed behind stage A. There is ample time to take corrective action since the condensing unit will operate on the remaining stages.

Figure 5:
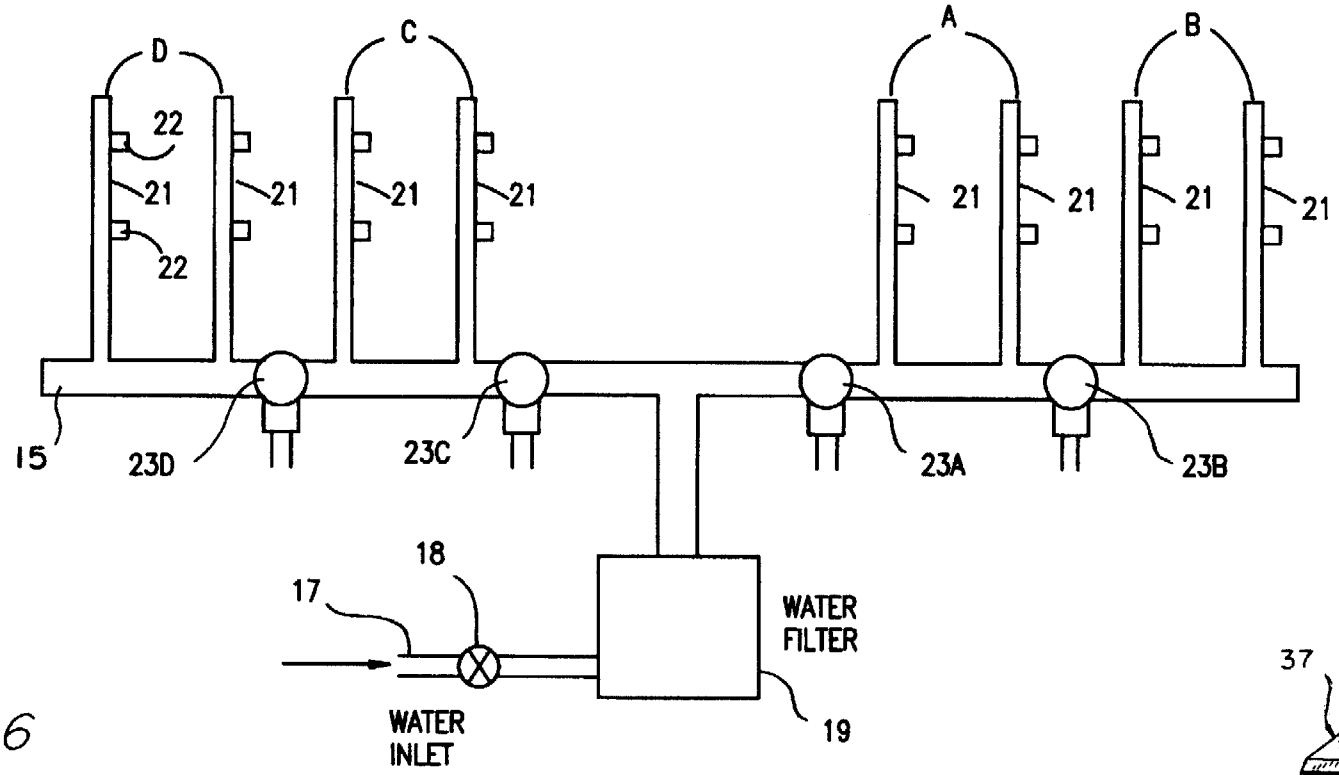
FIG. 5 is a circuit for a separately wired sensing unit to initiate spray system operation.

FIG. 5 shows a modification of the invention wherein the manifold 15 is fed by the water inlet 17 at a medial portion instead of one end. Since the components in FIG. 5 are the same as in FIGS. 1–3 (only the locations have been changed), the same reference numerals will be used. The advantages in the FIG. 5 embodiment is that the system flexibility can be increased because there are two inlet stages, namely A and C which may be interchanged by appropriate wiring connections to thermostats 24A and 24C.

Figure 6:
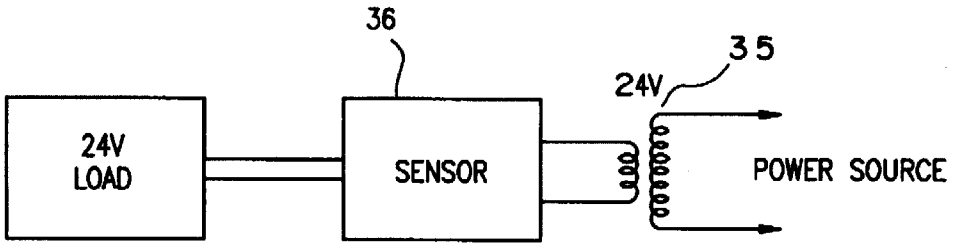
FIG. 6 is a side elevation sectional view of the snap-acting disc thermostats.

FIG. 6 shows a separate circuit to supply 24 volts to the spray system instead of tapping into the load side of contactor 28, as shown in FIG. 3. In FIG. 6, a separate 24 volt transformer 35 has a primary connected to a line source of voltage which may be 120V or 240V. The 24 volt output is connected to a commercially available sensor 36 which, when activated, closes a circuit to the 24 volt load devices comprising the solenoids 24. The sensor may be activated by vibration, sound, air flow, or motion detection.

Figure 7:
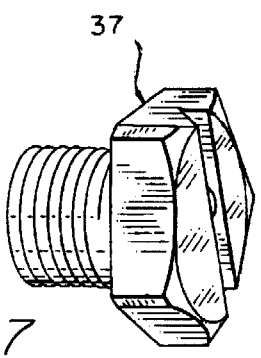
FIG. 7 is a perspective view of a spray nozzle.

The disclosed system employs a commercially available nozzle, as shown at 37 in FIG. 7. This nozzle is equipped with an internal strainer. It was determined through experimentation that for a 3 ton condensing unit, a nozzle having a flow rate of 0.6 gph with a fine mist projected at an angle of 70–75 degrees performed well. Each vertical pipe was equipped with two of these nozzles. Also, for reasons not completely understood by applicants, it was determined that the angle at which the spray mist strikes the condenser fins has an effect upon the rate of mineral deposit.

It is not intended to limit the present invention to the details of illustration or terms of description of the preferred embodiments shown above. It should be clearly understood that the invention can be applied to a wide range of condensing units with different sizes and shapes of condensers. The number of stages, the number of vertical tubes in each stage, the number and flow characteristics of the nozzles, and the temperature settings of the thermostats are all design parameters practiced within the scope of the invention to fit particular needs.

We claim:

1. In an outdoor air conditioning condensing unit having a wraparound condenser and a top mounted fan to draw ambient air through the condenser in combination with an externally mounted evaporative cooling system to spray water on the condenser to increase the rate of heat transfer, said evaporative cooling system comprising a tubular manifold encircling the base of the condensing unit coextensive with the wraparound condenser, said manifold having an inlet connected to a source of water pressure, a plurality of vertically extending pipes in fluid communication with said manifold and spaced along the manifold to overlie the condenser for its peripheral extent, each vertical pipe being provided with at least one spray nozzle, said vertical pipes being divided into a number of spray stages with each spray stage comprising at least one vertical pipe, an electrically controlled solenoid valve mounted in fluid control relationship in said manifold at the inlet of each said spray stages, a plurality of thermal switches arranged around the condenser internally of the condensing unit at locations to sense the temperature of the air leaving the condenser at the respective spray stage locations, each thermal switch being set at a different but increasing temperature setting, each thermal switch being electrically connected with a manifold solenoid valve associated with its respective spray stage whereby a modulated spray pattern is generated across said condenser as a function of condenser discharge air temperature.

2. The combination of claim 1 wherein the water pressure inlet is connected to one end of the manifold and the solenoid valves are connected in series flow relationship.

3. The combination of claim 1 wherein the water pressure inlet is connected to the manifold to divide it into two separate branches.

4. The combination of claim 2 wherein each spray stage and its associated inlet solenoid valve counting downstream away from the water pressure inlet are sequentially energized in accordance with an increasing temperature program as determined by the setting of the thermal switches.

5. The combination of claim 3 wherein each spray stage and its associated inlet solenoid valve counting downstream away from the water pressure inlet of each branch are sequentially energized in accordance with an increasing temperature program as determined by the setting of the thermal switches.

6. The combination of is claim 1 wherein a sail switch is mounted within the condensing unit on the opposite side of the condenser from the spray stage operative at the lowest temperature setting to close a circuit to a signalling device when the condenser is partially blocked.

7. The combination of claim 1 including a contactor for supplying power to the compressor when energized, a stepdown transformer having a 24 volt secondary for supplying power to the electrical components of the evaporative cooling system, the primary of the transformer being wired in parallel with the compressor whereby said evaporative cooling system is operative whenever the compressor is energized.

8. The combination of claim 1 including a stepdown transformer having a primary winding connected to a source of AC power and a 24 V secondary connected to a sensing device, said sensing device being operative to sense a physical signal resulting from the operation of the condensing unit, said sensing device, when activated, supplies 24 volts to the load devices in the evaporative cooling system.

9. The combination of claim 1 wherein said thermal switches comprise a snap-acting bimetal disc sealed in a protective housing.

10. A method of increasing the efficiency of an outdoor air conditioning condensing unit having a wraparound condenser and a top mounted fan to draw ambient air through the condenser, said method comprising installing a tubular manifold encircling the condensing unit coextensive with the wraparound condenser, connecting said manifold to a source of water pressure, installing a plurality of spaced vertically extending pipes in fluid communication with said manifold along the length thereof, providing each vertically extending pipe with at least one spray nozzle, grouping said vertically extending pipes into a number of spray stages comprising at least one vertical pipe, providing an electrically controlled valve in said manifold at the inlet of each spray stage, providing a plurality of thermal switches arranged around the condenser internally of the condensing unit, each switch being set out at a different operating temperature, connecting said switches in circuit with individual electrically controlled valves whereby a modulated spray pattern is directed toward the condenser depending upon the settings of said switches.

* * * * *